US011516581B2

(12) United States Patent
Takahashi et al.

(10) Patent No.: US 11,516,581 B2
(45) Date of Patent: Nov. 29, 2022

(54) INFORMATION PROCESSING DEVICE, MIXING DEVICE USING THE SAME, AND LATENCY REDUCTION METHOD

(71) Applicants: The University of Electro-Communications, Tokyo (JP); Hibino Corporation, Tokyo (JP)

(72) Inventors: Kota Takahashi, Tokyo (JP); Tsukasa Miyamoto, Tokyo (JP); Yoshiyuki Ono, Tokyo (JP); Yoji Abe, Kanagawa (JP)

(73) Assignees: The University of Electro-Communications, Tokyo (JP); Hibino Corporation, Tokyo (JP)

( * ) Notice: Subject to any disclaimer, the term of this patent is extended or adjusted under 35 U.S.C. 154(b) by 65 days.

(21) Appl. No.: 17/047,514

(22) PCT Filed: Apr. 11, 2019

(86) PCT No.: PCT/JP2019/015837
§ 371 (c)(1),
(2) Date: Oct. 14, 2020

(87) PCT Pub. No.: WO2019/203127
PCT Pub. Date: Oct. 24, 2019

(65) Prior Publication Data

US 2021/0152936 A1 May 20, 2021

(30) Foreign Application Priority Data

Apr. 19, 2018 (JP) ..... JP2018-080670

(51) Int. Cl.
*H04R 3/04* (2006.01)
*G10L 25/18* (2013.01)

(52) U.S. Cl.
CPC ..... *H04R 3/04* (2013.01); *G10L 25/18* (2013.01)

(58) Field of Classification Search
CPC ..... H04R 3/04; G10L 25/18
(Continued)

(56) References Cited

U.S. PATENT DOCUMENTS 5,228,093 A 7/1993 Agnello
6,587,816 B1 7/2003 Chazan et al.
(Continued)

FOREIGN PATENT DOCUMENTS

EP 2860989 4/2015
JP 2010-081505 4/2010
(Continued)

OTHER PUBLICATIONS

Andersen, K.T. and Moonen, M., "Adaptive time-frequency analysis for noise reduction in an audio filter bank with low delay", Apr. 2016, IEEE/ACM Transactions on Audio, Speech, and Language Processing, 24(4), pp. 784-795. (Year: 2016).*
(Continued)

*Primary Examiner* — Daniel R Sellers
(74) *Attorney, Agent, or Firm* — IPUSA, PLLC

(57) ABSTRACT

An information processing device includes a first time-frequency converter configured to perform a time-frequency conversion with respect to an input signal, using a window function having a first width, a second time-frequency converter configured to perform a time-frequency conversion with respect to the input signal, using a second window function having a second width smaller than the first width, and a modification processing unit configured to modify an output of the second time-frequency converter, using a frequency analysis result based on an output of the first time-frequency converter.

14 Claims, 8 Drawing Sheets

(58) Field of Classification Search
USPC ..... 381/98
See application file for complete search history.

(56) References Cited

U.S. PATENT DOCUMENTS

| | | | | |
|---|---|---|---|---|
| 9,715,884 | B2 * | 7/2017 | Kitazawa | G10L 25/84 |
| 2008/0269930 | A1 | 10/2008 | Yamashita et al. | |
| 2010/0128882 | A1 | 5/2010 | Yamabe et al. | |
| 2011/0317852 | A1 | 12/2011 | Kawano | |
| 2012/0130516 | A1 | 5/2012 | Reinsch et al. | |
| 2013/0272542 | A1 | 10/2013 | Tracey | |
| 2014/0219478 | A1 | 8/2014 | Takahashi et al. | |
| 2016/0261961 | A1 * | 9/2016 | Andersen | H04R 25/505 |
| 2017/0048641 | A1 | 2/2017 | Franck | |
| 2018/0035205 | A1 | 2/2018 | Vautin et al. | |

FOREIGN PATENT DOCUMENTS

| | | |
|---|---|---|
| JP | 2012-010154 | 1/2012 |
| JP | 2013-051589 | 3/2013 |
| JP | 2013-164572 | 8/2013 |
| JP | 2016-134706 | 7/2016 |
| WO | 2006/085265 | 8/2006 |

OTHER PUBLICATIONS

Mauler D. and Martin R., "A low delay, variable resolution, perfect reconstruction spectral analysis-synthesis system for speech enhancement", Sep. 3, 2007, IEEE, 15th European Signal Processing Conference, pp. 222-226. (Year: 2007).*

Heinzel et al., "Spectrum and spectral density estimation by the Discrete Fourier transform (DFT), including a comprehensive list of window functions and some new at-top windows", Feb. 15, 2002, https://holometer.fnal.gov/GH_FFT.pdf, pp. 1-84 (Year: 2002).*

Smith, J.O., "Spectral Audio Signal Processing", Mar. 2016, http://ccrma.stanford.edu/~jos/sasp/, online book, 2011 edition, accessed through archive.org as published online Mar. 2016, pp. 1-18 (Year: 2016).*

Office Action dated Nov. 29, 2021 issued with respect to the related U.S. Appl. No. 17/047,504.

International Search Report dated May 21, 2019 with respect to PCT/JP2019/015832.

International Search Report dated May 21, 2019 with respect to PCT/JP2019/015837.

International Search Report dated May 28, 2019 with respect to PCT/JP2019/015834.

Sep. 27, 2017, pp. 465-468, ISSN 1880-7658, in particular, pp. 465-466, fig. 3-4, non-official translation (Katsuyama, Shun et al., "Performance enhancement of smart mixer on condition of stereo playback", Lecture proceedings of 2017 autumn meeting the Acoustical Society of Japan CD-ROM, Acoustical Society of Japan).

Florencio D A F Ed—Institute of Electrical and Electronics Engineers: "On the use of asymmetric windows for reducing the time delay in real-time spectral analysis", Speech Processing 1. Toronto, May 14-17, 1991; [International Conference on Acoustics, Speech & Signal Processing. ICASSP], New York, IEEE, US, vol. Conf. 16, Apr. 14, 1991 (Apr. 14, 1991), pp. 3261-3264, XP010043720, DOI: 10.1109/ICASSP.1991.150149 ISBN: 978-0-7803-0003-3 *the whole document*.

Extended European Search Report dated Apr. 29, 2021 with respect to the related European Patent Application No. 19787973.7.

Partial Search Report dated Apr. 29, 2021 with respect to the corresponding European Patent Application No. 19787843.2.

Extended European Search Report dated May 18, 2021 with respect to the related European Patent Application No. 19788613.8.

Extended European Search Report dated Aug. 25, 2021 with respect to the corresponding European Patent Application No. 19787843.2.

* cited by examiner

INFORMATION PROCESSING DEVICE, MIXING DEVICE USING THE SAME, AND LATENCY REDUCTION METHOD

TECHNICAL FIELD

The present invention relates to an information processing device, a mixing device using the same, and a latency reduction method, and more particularly to latency reduction techniques in frequency analysis.

BACKGROUND ART

A smart mixer analyzes an input signal, modifies or adjusts the input signal based on an analysis result, and obtains a preferable mixed output. By mixing priority sound and non-priority sound on a time-frequency plane, an articulation of the priority sound can be increased, while maintaining a sense of volume of the non-priority sound (for example, refer to Patent Document 1 and Patent Document 2).

FIG. 1 is a schematic diagram of a conventional smart mixer. An input signal $x_1[n]$ of the priority sound, and an input signal $x_2[n]$ of the non-priority sound, are expanded into a signal $X_1[i, k]$ and a signal $X_2[i, k]$ on the time-frequency plane, respectively, by multiplying a window function to the input signals, to perform a short-time Fast Fourier Transform (FFT). Powers of the priority sound and the non-priority sound are respectively calculated at each point (i, k) on the time-frequency plane, and smoothened in a time direction. A gain $\alpha_1[i, k]$ of the priority sound and a gain $\alpha_2[i, k]$ of the non-priority sound on the time-frequency plane are derived, based on smoothened powers $E_1[i, k]$ and $E_2[i, k]$ of the priority sound and the non-priority sound. The gains $\alpha_1[i, k]$ and $\alpha_2[i, k]$ obtained by the series of analysis are multiplied to the signals $X_1[i, k]$ and $X_2[i, k]$ on the time-frequency plane, respectively, and a mixed signal $Y[i, k]$ is obtained by adding results of the multiplication. The mixed signal $Y[i, k]$ is restored to a signal in a time domain, and output.

Two basic principles are used to derive the gains, namely, the "principle of the sum of logarithmic intensities" and the "principle of fill-in". The "principle of the sum of logarithmic intensities" limits the logarithmic intensity of the output signal to a range not exceeding the sum of the logarithmic intensities of the input signals. The "principle of the sum of logarithmic intensities" reduces an uncomfortable feeling that may occur with regard to the mixed sound due to excessive emphasis of the priority sound. The "principle of fill-in" limits the reduction of the power of the non-priority sound to a range not exceeding a power increase of the priority sound. The "principle of fill-in" reduces the uncomfortable feeling that may occur with regard to the mixed sound due to excessive reduction of the non-priority sound. A more natural mixed sound is output by rationally determining the gain based on these principles.

PRIOR ART DOCUMENTS

Patent Document

Patent Document 1: Japanese Patent No. 5057535

Patent Document 2: Japanese Laid-Open Patent Publication No. 2016-134706

DISCLOSURE OF THE INVENTION

Problem to be Solved by the Invention

When the analysis required by the smart mixer is performed sufficiently, there are cases where a latency of the mixing process exceeds 20 ms. On the other hand, the latency required at a mixing site is less than 20 ms, and desirably 5 ms or less.

For example, assume a case where a musician listens to the sound from a speaker of a Public Address (PA) device at a concert venue. In this case, it is known that a large latency from a microphone to the speaker in an electro-acoustic system may cause trouble in the performance.

There are considerable individual differences in sound perception, and no clear objective criteria has been established concerning the need to reduce this latency to a specific number of milliseconds or less. Generally, it is common knowledge that the uncomfortable feeling often occurs when the latency exceeds 20 ms, while the uncomfortable feeling may not occur when the latency is 15 ms or less. On the other hand, there is a theory that the latency of several milliseconds or less is required for ear monitors worn by the musician.

According to the common knowledge described above, the latency exceeding 20 ms in the smart mixer is too large for the mixing criteria in concert venues and recording studios.

One object of the present invention is to reduce the latency from signal input to output in an information processing system including frequency analysis. In addition, another object of the present invention is to provide a mixing device applied with the latency reduction technique.

Means of Solving the Problem

According to a first aspect of the present invention, an information processing device includes a first time-frequency converter configured to perform a time-frequency conversion with respect to an input signal, using a window function having a first width;

a second time-frequency converter configured to perform a time-frequency conversion with respect to the input signal, using a second window function having a second width smaller than the first width; and a modification processing unit configured to modify an output of the second time-frequency converter, using a frequency analysis result based on an output of the first time-frequency converter.

According to a second aspect of the present invention, an information processing device includes a time-frequency converter configured to subject an input signal to a time-frequency conversion;

a digital filter configured to modify the input signal;

a frequency analysis processing unit configured to perform a frequency analysis based on an output of the time-frequency converter;

a frequency-time converter configured to subject a result of the frequency analysis to a frequency-time conversion, to output a time domain analysis result; and a reducing unit configured to reduce the time domain analysis result, wherein the reduced time domain analysis result is applied to the digital filter, to modify the input signal.

Effects of the Invention

According to the configuration described above, the latency can be reduced in the information processing system including the frequency analysis. The reduced latency enables real-time information analysis or mixing process.

MODE OF CARRYING OUT THE INVENTION

The present inventors have found that the latency is generated in each of blocks of signal processing, and the final latency becomes a sum of the latencies in each of the blocks, and that latency in a particular block becomes dominant in the case of the smart mixer.

The smart mixer expands an input signal $x_i[n]$ of priority sound, and an input signal $x_2[n]$ of non-priority sound, into a signal $X_j[i, k]$(j=1, 2) on a time-frequency plane, by multiplying a window function to the input signals $x_1[n]$ and $x_2[n]$, to perform a short-time Fast Fourier Transform (FFT) and an analysis on the time-frequency plane. This expansion to the time-frequency plane may be represented by a formula (1).

[Formula 1]

$$X_j[i, k] = \sum_{m=-N_h+1}^{N_h-1} h[m]x_j[iN_d + m]\exp\left(-\frac{2\pi ikm}{N_F}\right) \quad (j = 1, 2) \tag{1}$$

Based on the analysis result on the time-frequency plane, the mixing to increase the articulation of the priority sound is performed by modifying or adjusting $X_j$ [i, k] (j=1, 2).

In the formula (1), h[m] denotes the window function. h[m] is a function that is zero (0) when $|m|>=N_h$, and in the following description, $N_h$ will be referred to as a width (half-width to be more accurate) of the window function. $N_d$ denotes the number of frames shifted, and $N_F$ denotes the number of FFT points. In addition, in a case where the same process can be represented using a plurality of $N_h$, a minimum value thereof will be assumed to be the width $N_h$ of the window function.

In order to minimize the effect of the multiplication of the window function h[m] on $X_j[i, k]$, h[m] in many cases is selected to a function that first, assumes a maximum value at h[0], and second, symmetrical (that is, h[−m]=h[m]) around m=0.

In the following description, it is assumed that the short-time FFT is performed with one sample shift, that is, $N_d$=1. In this case, i may be replaced by n. In addition, when returning the output Y[i, k] on the time-frequency plane to the output in the time domain, the conversion may be made by a simple calculation of a formula (2), instead of using an inverse FFT.

[Formula 2]

$$y[n] = \frac{1}{N_F}\sum_{k=0}^{N_F-1} Y[n, k] \tag{2}$$

Figure 1:
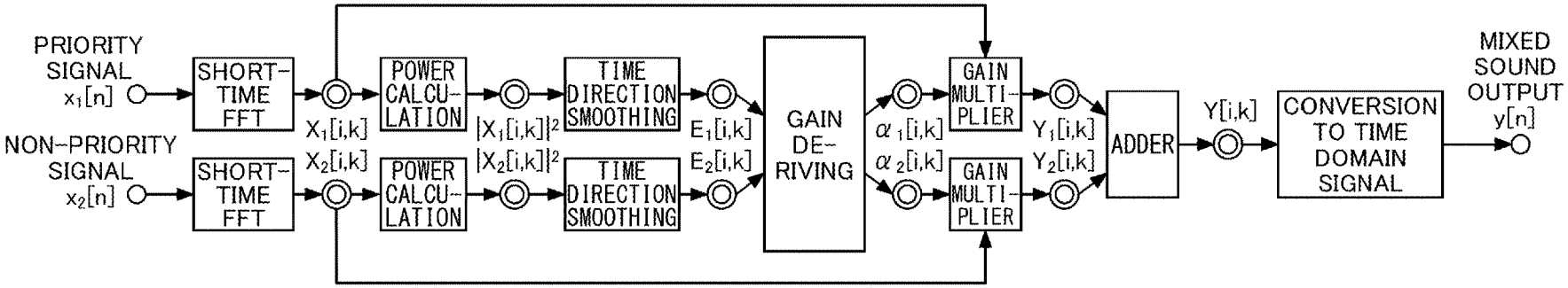
FIG.1 RELATED ART
FIG. 1 is a schematic diagram of a conventional smart mixer.

Next, the latency of the process of the smart mixer will be observed. Each of the blocks in FIG. 1 has a latency. In other words, in the process of the smart mixer, a sum of (a) a latency of performing the short-time FFT by multiplying the window function, (b) a latency of power calculation, (c) a latency of smoothing in the time direction, (d) a latency of gain calculation, (e) a latency of gain multiplication, (f) a latency of addition, and (g) a latency when performing conversion to a time-domain signal, becomes the final latency.

The latency element (a) is the latency generated by the process of the formula (1). Since the formula (1) uses a value of $x_j$[ ] that is $(N_h-1)$ samples into the future, a latency of $(N_h-1)/F_S$ seconds is generated upon implementation, where $F_S$ denotes a sampling frequency. P A magnitude of the latency is calculated below. In order to clearly separate harmonic components of speech, $N_h$ (the width of window function) needs to be approximately 1024 when $F_S$=48 kHz. As a result, a latency of $(N_h-1)/F_S$=1023/48=21.3 ms is generated.

In a case where the smart mixer is implemented in a logic device, such as a Field Programmable Gate Array (FPGA) or the like, the latency elements (b) through (f) are negligibly small compared to the latency element (a). Further, the latency element (g) is the latency of the formula (2), and is also negligibly small compared to the latency element (a).

Accordingly, the latency of the short-time FFT, performed by multiplying the window function of the latency element (a), dominates the overall latency, and in the smart mixer having a sufficiently high performance, the magnitude of the latency is approximately 21.3 ms.

The smart mixer having such a large latency is unsuited for a real-time mixing process performed in a concert hall. For this reason, there are demands to a technique that can reduce the latency.

As described above, the latency is mainly generated at a stage where the signal in the time domain is converted into the signal in a time-frequency domain, and the width $N_h$ of the window function dominates the size of the latency.

When the width $N_h$ of the window function is reduced in order to reduce the latency, the frequency resolution of the analysis deteriorates, and a processing load is applied also to a point (i, k) on the time-frequency plane, that originally does not need to be emphasized or reduced due to the frequency difference.

Moreover, in order to make the process on the time-frequency plane more suitable to the human hearing, it is conceivable to make a conversion from a linear frequency axis into the Bark axis, but when $N_h$ is reduced in this case, it becomes difficult to appropriately represent a spectrum of a low-frequency portion when the conversion to the Bark axis is made. This is because the Bark axis uses a scale corresponding to 24 critical bands of the human hearing, and a high frequency resolution is required in the low-frequency band.

Based on the observations described above, the analysis needs to be performed with the high frequency resolution, using the window having the width that is as wide as possible (that is, large latency), in order to perform the frequency analysis of the input signal.

On the other hand, the input data ($X_j$[i, k]) in the time-frequency domain is not only used for a series of analyzing processes, but is also used as a material for constructing the output data by multiplying a derived gain mask. In other words, the input data ($X_j$[i, k]) is also used to modify data.

Consideration will be made on requirements of the data in the time-frequency domain, to be modified or adjusted. In the case of the smart mixer, a final gain mask is made to be smooth in both the frequency axis direction and the time axes direction, in order to prevent perception as if artificial noise were mixed to the output. Because a change of the gain in the frequency axis direction is smooth, the high frequency resolution is not particularly required to modify the data or the input signal. In addition, since the change in the gain is also smooth in the time axis direction, the effect itself of the gain mask is not so much affected even when the gain mask is slightly shifted in the time axis direction.

However, the latency of the entire system is determined exclusively by the conversion to the time-frequency domain prior to the data modification, the latency generated by this conversion needs to be reduced as much as possible.

Accordingly, the required specifications differ between the time-frequency conversion for the analysis of the input signal, and the time-frequency conversion for modifying the data.

Based on the findings described above, the present invention applies different processes for the signal analysis and the signal modification. Specific techniques for these processes will be described in the following.

First Embodiment

Figure 2:
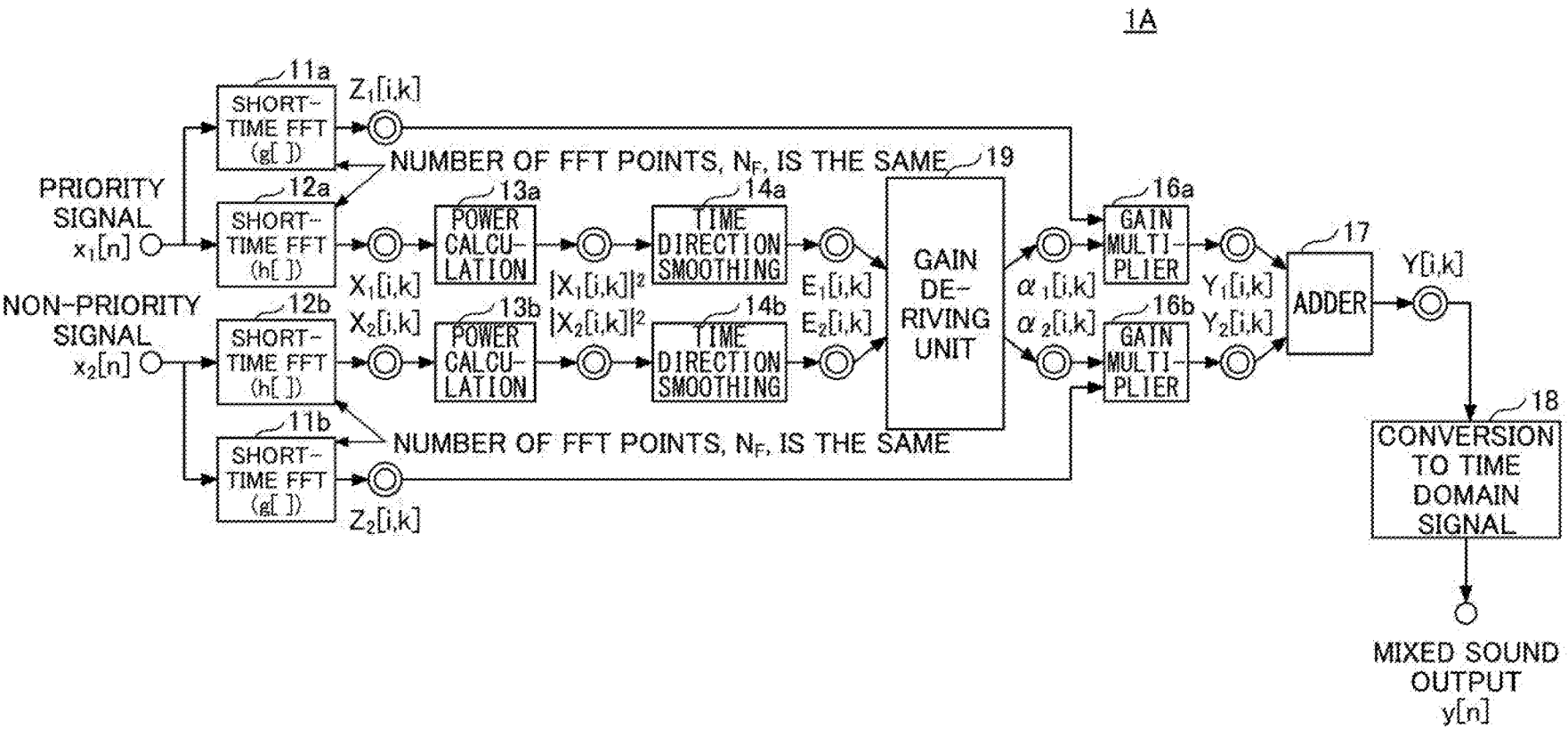
FIG. 2 is a diagram illustrating a technique and a configuration for latency reduction according to a first embodiment.

FIG. 2 is a diagram illustrating a method and a technique for latency reduction according to a first embodiment. The signal processing technique including latency reduction of FIG. 2 may be applied, for example, to a mixing device 1A that mixes the priority sound and the non-priority sound.

In the first embodiment, a time-frequency converter for signal analysis, and a time-frequency converter for signal modification, are provided separately, and a different latency window function is applied to each of the time-frequency converters. A result of the signal analysis corresponding to a given time is used for a future signal conversion, to achieve both high-resolution frequency analysis and low-latency signal conversion.

In FIG. 2, an analyzing window and a modifying window, are separately provided with respect to the input signal $x_1$[n] of the priority sound and the input signal $x_2$[n] of the non-priority sound, respectively, and different latencies are set to the analyzing window and the modifying window.

A modifying FFT 11*a* and an analyzing FFT 12*a* are provided, in order to convert the input signal $x_1$[i, k] of the priority sound into a signal in the time-frequency domain. The input signal $x_1$[n] is converted into an input signal $Z_1$[i, k] on the time-frequency plane by the modifying FFT 11*a*, and input to a multiplier 16*a* for gain multiplication. The input signal $x_1$[n] is also converted into a signal $X_1$[i, k] on the time-frequency plane by the analyzing FFT 12*a*. The signal $X_1$[i, k] is subjected to the analyzing processes in each of blocks including a power calculation unit 13*a*, a time direction smoothing unit 14*a*, and a gain deriving unit 19.

A modifying FFT 11*b* and an analyzing FFT 12*b* are also provided, in order to convert the input signal $x_2$[n] of the non-priority sound into a signal in the time-frequency domain. The input signal $x_2$[n] is converted into an input signal $Z_2$[i, k] on the time-frequency plane by the modifying FFT 11*b*, and input to a multiplier 16*b* for gain multiplication. The input signal $x_2$[n] is also converted into signal $X_2$[i, k] on the time-frequency plane by analyzing FFT 12*b*. The signal $X_2$[i, k] is subjected to processes in each of blocks including a power calculation unit 13*b*, a time direction smoothing unit 14*b*, and the gain deriving unit 19.

The gain deriving unit 19 calculates a gain $\alpha_1$[i, k] to be multiplied to the signal $X_1$[i, k] and a gain $\alpha_2$[i, k] to be multiplied to the signal $X_2$[i, k], based on a smoothing power $E_1$[i, k] of the priority sound in the time direction, and a smoothing power $E_2$[i, k] of the non-priority sound in the time direction.

The gain $\alpha_1$[i, k] is multiplied to the signal $X_1$[i, k] in the multiplier 16*a*, and the gain $\alpha_2$[i, k] is multiplied to the signal $X_2$[i, k] in the multiplier 16*b*. The multiplication results are added in an adder 17, and output after being restored to the signal in the time domain by a time domain converter 18.

Since the processing with respect to the priority sound and the processing with respect to the non-priority sound are the same, the input signal is denoted by $x_j$ in the following description. In addition, the modifying FFT 11*a* and the modifying FFT lib will be generally referred to as the "FFT 11", as appropriate, and the analyzing FFT 12*a* and the analyzing FFT 12*b* will be generally referred to as the "FFT 12", as appropriate.

The input signal $x_j$ is converted into $X_j$[n, k] by the FFT 12 according to the above described formula (1), using the analyzing window function h[ ]. A formula (3) may be obtained when the formula (1) is rewritten in terms of the sample shift $N_d$=1.

[Formula 3]

$$X_j[n,k] = \sum_{m=-N_h+1}^{N_h-1} h[m]x_j[n+m]\exp\left(-\frac{2\pi ikm}{N_F}\right) \tag{3}$$

At the same time, the input signal $x_j$ is converted into $Z_j$[n, k] by the FFT 11 according to a formula (4), using the modifying window function g[ ].

[Formula 4]

$$Z_j[n,k] = \sum_{m=-N_{gL}+1}^{N_{gH}-1} g[m]x_j[n+m]\exp\left(-\frac{2\pi ikm}{N_F}\right) \tag{4}$$

Here, g[m] is a window function that is zero (0) when $m<=-N_{gL}$ and $m>=N_{gH}$.

The formula (3) and the formula (4) are processed by the FFTs having the same number of points ($N_F$). On the other hand, the formula (3) and the formula (4) have different window widths, and thus, have different latencies. More particularly, since the formula (3) requires the signal of $N_h-1$ samples into the future, the latency is $(N_h-1)/F_S$, and since the formula (4) requires the signal of $N_{gH}-1$ samples into the future, the latency is $(N_{gH}-1)/F_S$.

In a path from the FFT 11 to the multiplier 16, the latency is shortened to reduce the time, and in a path from the FFT 12 to the multiplier 16, the latency is lengthened to maintain the high frequency resolution.

Figure 3:
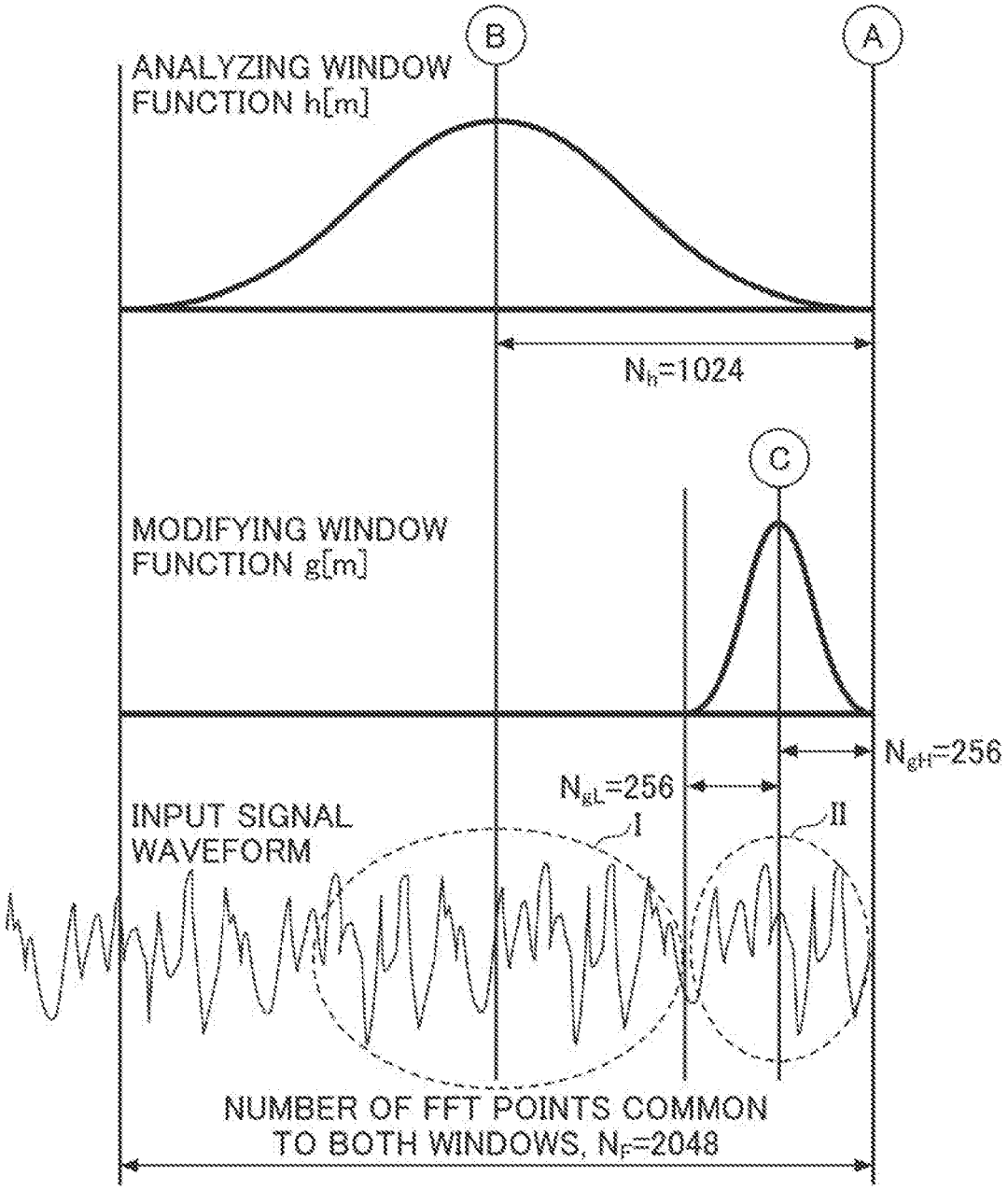
FIG. 3 illustrates a relationship of an analyzing window function h[n], a modifying window function g[n], and an input waveform.

FIG. 3 illustrates a relationship of the analyzing window function h[n], the modifying window function g[n], and an input waveform. It is assumed that currently, the input signal is observed up to a point A. In this state, the analyzing window function h[m] is arranged at a position where a most recent data is positioned at a right end (point A) of the window. The FFT using this window function has a center, that is, the position where m=0 is applied according to the formula (3), placed at a point B. In other words, this FFT generates the analysis result at the point B. Hence, a latency, corresponding to a time interval between the point A and the point B, is generated.

On the other hand, the modifying window function g[ ] is also arranged at the position where the most recent data is positioned at the right end of the window, and thus, the FFT using this window function has a center plated at a point C. In this case, a latency, corresponding to a time interval between the point A and the point C, is generated.

According to the setting in FIG. 3, the latency of the analyzing window function h[ ] is 1023, and the latency of the modifying window function g[ ] is 255.

At this point in time, the analysis result, for up to the point B, is obtained. However, the frequency domain data itself for the modification is obtained, for up to the point C. If a modifying process performed at a certain time were required to use the analysis result of the same certain time, the modifying process may wait until the analysis progresses to the point C. However, the latency in this case would become 1023, thereby making it meaningless to the use of the modifying window function g[ ] having the small latency.

Therefore, data having a time lag therebetween are used intentionally. In other words, the analysis result at the point B is used for the modifying process at the point C. Conversely, when performing the modifying process on the input signal, the frequency analysis result obtained prior to the modifying process is used. Primary data used in the frequency analysis, is a portion of the input signal encircled by a circle I. The gain mask is generated based on the primary data, and the gain mask is used to modify the data near a circle II. In the case of the smart mixer, since the gain mask gradually varies in the time axis direction, the effect on the output is slight even when the data having the time lag therebetween are used.

Figure 4:
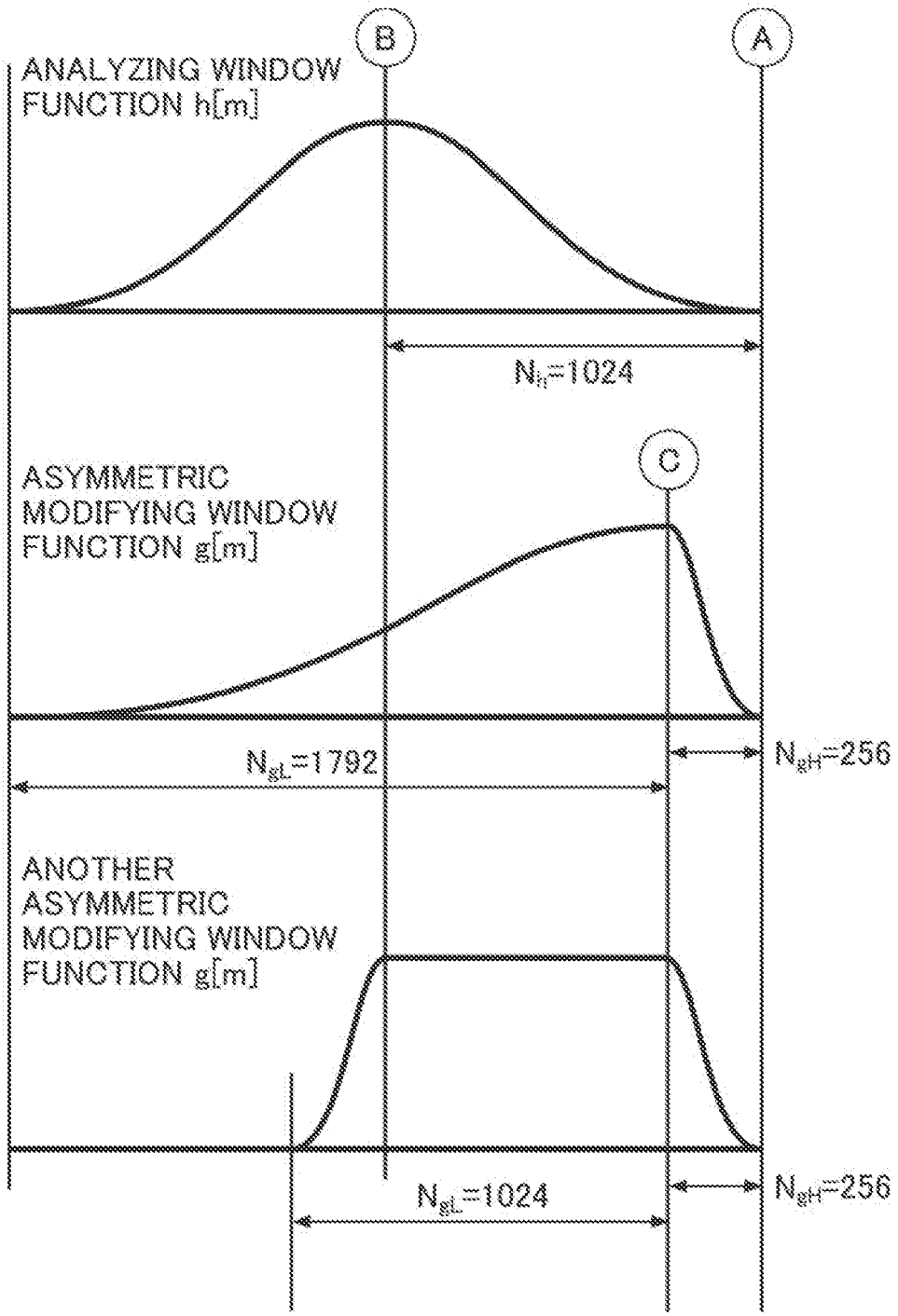
FIG. 4 is a diagram illustrating an example using an asymmetric window function as the modifying window function.

FIG. 4 illustrates an example using an asymmetric window function as the modifying window function. The asymmetric window function may be used as the modifying window function. A top row illustrates the analyzing window function h[ ], a middle row illustrates an asymmetric modifying window function g[ ], and a bottom row illustrates another example of the asymmetric modifying window function.

In the asymmetric modifying window function g[ ], the position of the point C (the position restored by the formula (2)) may be determined as the position of the window function where m=0. This position may be an arbitrary position in the window function in a range in which the value of the window function is not zero.

By using the asymmetric window function for the modifying window function g[ ], an effective length of the window function can be extended while maintaining the latency (for example, the width $N_gH$=256 of the window function), and the frequency resolution of the time-frequency conversion for the modification can be increased to a certain extent. Compared to a symmetric window function, the conversion is made to the frequency domain by placing emphasis on past data, but the latency itself is the same as that of the symmetric window function.

The technique and the configuration of the first embodiment perform the processes with the FFTs having the same number of points, while using the window functions having latencies that are different for the analysis and the modification. The number of frequency bins of the gain mask is the same as the number of frequency bins of the time-frequency converted data for the modification, and the multipliers 16*a* and 16*b* may perform the conventional processing as is.

When the present inventors executed the technique of the first embodiment, it was possible to reduce the latency to approximately 5 ms. In addition, it was confirmed that the sound quality of the output when the latency reduction process is performed, can be maintained approximately the same as that of the smart mixer that does not reduce the latency.

Second Embodiment

Figure 5:
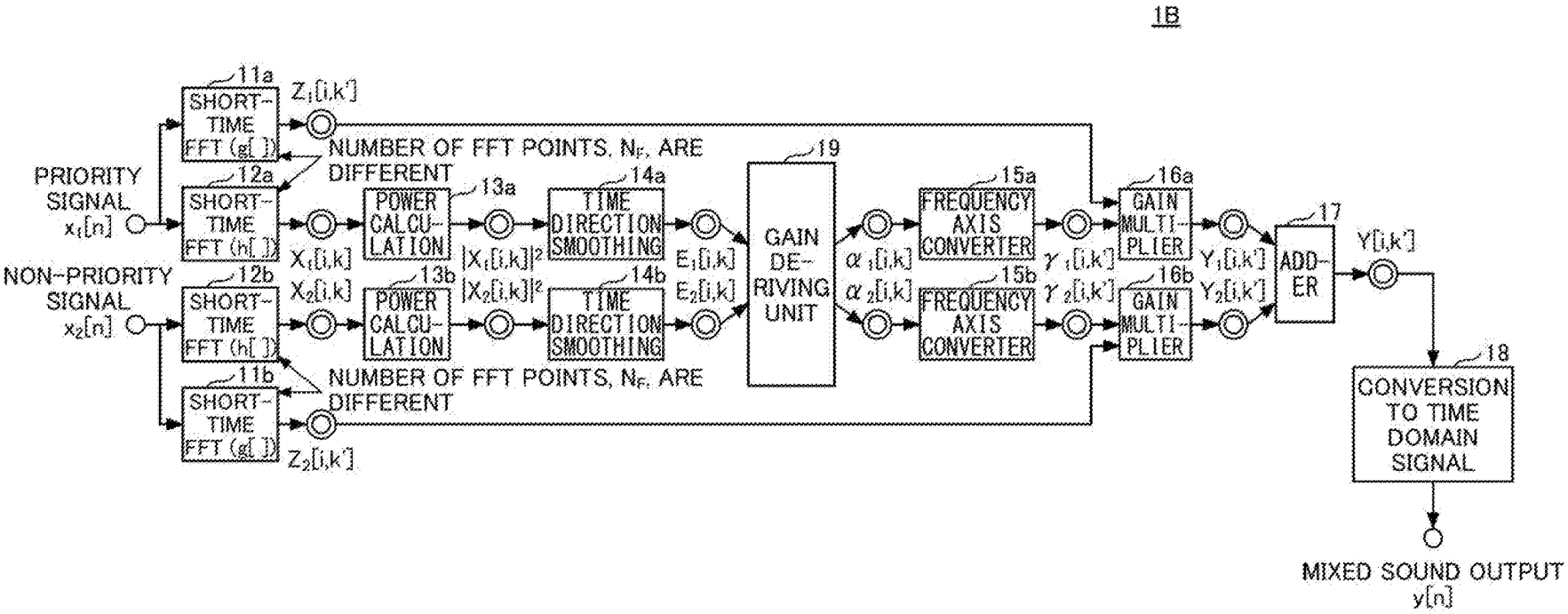
FIG. 5 is a diagram illustrating the technique and the configuration for the latency reduction according to a second embodiment.

FIG. 5 is a diagram illustrating the technique and the configuration of the latency reduction according to a second embodiment. The signal processing technique including latency reduction of FIG. 5 may be applied, for example, to a mixing device 1B that mixes the priority sound and the non-priority sound.

In the first embodiment, the modifying FFT 11 and the analyzing FFT 12 perform processes using the same number of points. However, in a case where $N_{gL}+N_{gH}<2N_h$, the time-frequency conversion for the modification may be processed by an FFT using a smaller number of points. For example, in the case of FIG. 3, an FFT using 512 points may be sufficient for use as the modifying FFT.

Accordingly, in the second embodiment, different FFTs are used for the modifying FFT 11 and the analyzing FFT 12. In this case, a discrepancy occurs at the gain mask multiplier 16 between the number of bins of the gain mask and the number of bins of a data Z to be subjected to a multiplication, and thus, a process is required to match the number of bins of the gain mask to the number of bins of the data Z.

More particularly, frequency axis converters 15*a* and 15*b* are inserted at a stage subsequent to the gain deriving unit 19, to generate a gain $\gamma_j[i, k']$ in which a variable k (a frequency bin number) of a gain $\alpha_j[i, k]$ is converted from k to k', and multiply the gain $\gamma_j[i, k']$ to a data $Z_j[i, k']$.

According to the configuration of the second embodiment, it is possible to enhance the priority sound and reduce the non-priority sound by the gain multiplication, while reducing the latency, and reducing a load on the FFT by a modifying data.

Third Embodiment

Figure 6:
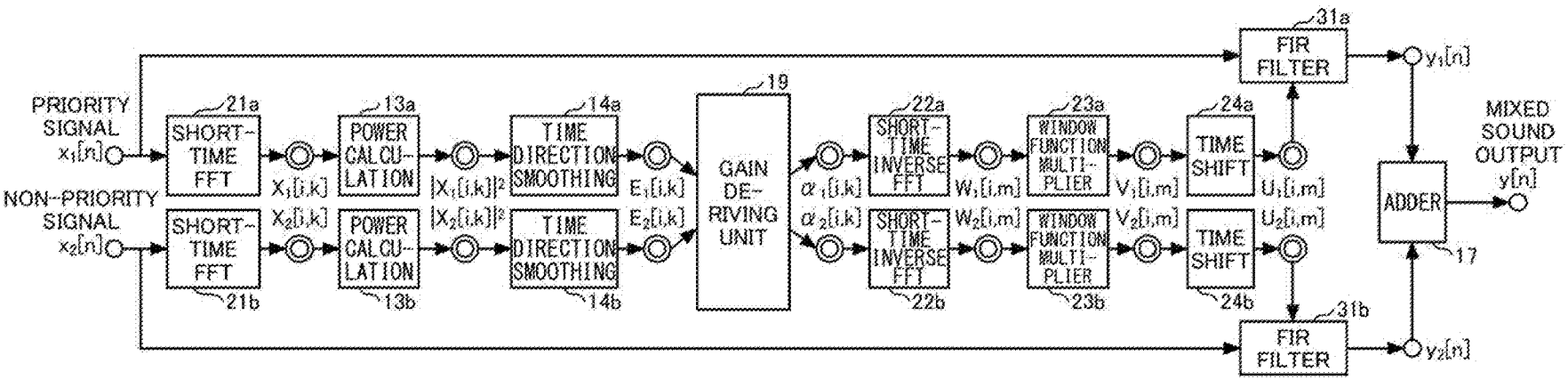
FIG. 6 is a diagram illustrating the technique and the configuration for the latency reduction according to a third embodiment.

FIG. 6 is a diagram illustrating the technique and the configuration for the latency reduction according to a third embodiment. The signal processing technique including latency reduction of FIG. 6 may be applied, for example, to a mixing device 1C that mixes the priority sound and the non-priority sound. In the mixing device 1C, those constituent elements that are the same as the constituent elements of the first embodiment and the second embodiment are designated by the same reference numerals, and a repeated description thereof will be omitted.

An essence of smart mixing is to multiply a gain $\alpha_1[i, k]$ and a gain $\alpha_2[i, k]$ to the input signal. In the first embodiment and the second embodiment, the gain multiplication process is performed by multiplying the gain mask after the conversion into the time-frequency domain, and thereafter restoring the domain back to the time domain.

A process that is consequently equivalent to that of the first embodiment and the second embodiment may be performed by another method. For example, a Finite Impulse Response (FIR) filter, equivalent to multiplying the gain mask, may be configured, and this FIR filter may be used to modify the signal.

In the mixing device 10, the processes of performing the short-time FFT with respect to the input signals of the priority sound and the non-priority sound by the FFT 21*a* and the FFT 21*b*, and obtaining the gains $\alpha_1[i, k]$ and $\alpha_2[i, k]$ by the gain deriving unit 19, are the same as those described above.

An inverse FFT 22*a*, a window function multiplier 23*a*, a time shift unit 24*a*, and an FIR filter 31*a* are provided in a priority sound signal processing system, in place of the multiplier that multiplies the gain. Similarly, an inverse FFT 22*b*, a window function multiplier 23*b*, a time shift unit 24*b*, and an FIR filter 31*b* are provided in a non-priority sound signal processing system.

The input signal $x_i[n]$ of the priority sound is input to the FFT 21*a* and the FIR filter 31*a*. The input signal $x_2[n]$ of the non-priority sound is input to the FFT 21*b* and the FIR filter 31*b*. The FIR filters 31*a* and 31*b* perform the process equivalent to multiplying the gain mask, to modify the input signals. This process is described below.

First, since it is assumed that $N_d=1$, i matches a sample number, and the gain masks will hereinafter be represented by $\alpha_1[n, k]$ and $\alpha_2[n, k]$.

According to the signal processing theory, an inverse Fourier transform of a transfer function is an impulse response. Hence, an inverse transform of the gain mask $\alpha_j[n, k]$ an impulse response (that is, FIR filter coefficient) $W_j[n, m]$ with respect to a point in time, n, and a delay difference (that is, a tap number) m. The impulse response $W_j[n, m]$ may be represented by a formula (5).

[Formula 5]

$$W_j[n, m] = \frac{1}{N_F}\sum_{k=0}^{N_F-1}\alpha_j[n, k]\exp\left(\frac{2\pi ikm}{N_F}\right) \tag{5}$$

$W_j[n,m]$ is calculated in a range $-N_F/2<=m<N_F/2$ using the formula (5). The same effect as multiplying the gain mask may be obtained by causing the FIR filter, having this impulse response as the coefficient thereof, to act on the input signal $x_j[n]$ as indicated by the formula (6).

[Formula 6]

$$y_j[n] = \sum_{m=-N_F/2}^{N_F/2-1} W_j[n, m]x_j[n-m] \tag{6}$$

In the formula (6), $x_j[n]$ of $N_F/2$ samples into the future $x_j[n]$ is used to calculate a mixed sound $y_j[n]$ that is output. Accordingly, when the FIR filter 31 for executing the formula (6) is implemented, the latency becomes $N_F/2$. When $N_F=1024$ and the sampling frequency $F_S$ is 48 kHz, $N_F/(2\times F_S)=21.3$ ms, which does not lead to latency reduction.

Hence, as in the first embodiment, the frequency resolution of a modification processing system with respect to the input data is reduced, to reduce the latency. For example, in order to reduce the frequency resolution, the gain $\alpha_j[n, k]$ may be smoothened in a frequency direction, and a decimation may be performed thereafter in the frequency direction, to reduce the number of bins. However, a calculation load of the smoothing becomes large according to this method.

A more appropriate technique may perform an inverse FFT on the gain $\alpha_j[i, k]$ to obtain a FIR filter coefficient $W_j[n, m]$, and thereafter truncate (multiply) using the window function, as illustrated in FIG. 6. Multiplying the FIR filter coefficient by the window function, smoothens the gain by the function that is obtained by the inverse Fourier transform of the window function, and thus, a process that is substantially the same as smoothing can be performed. In addition, this technique is more superior since the calculation load of the multiplication is small compared to that of the smoothing.

Figure 7:
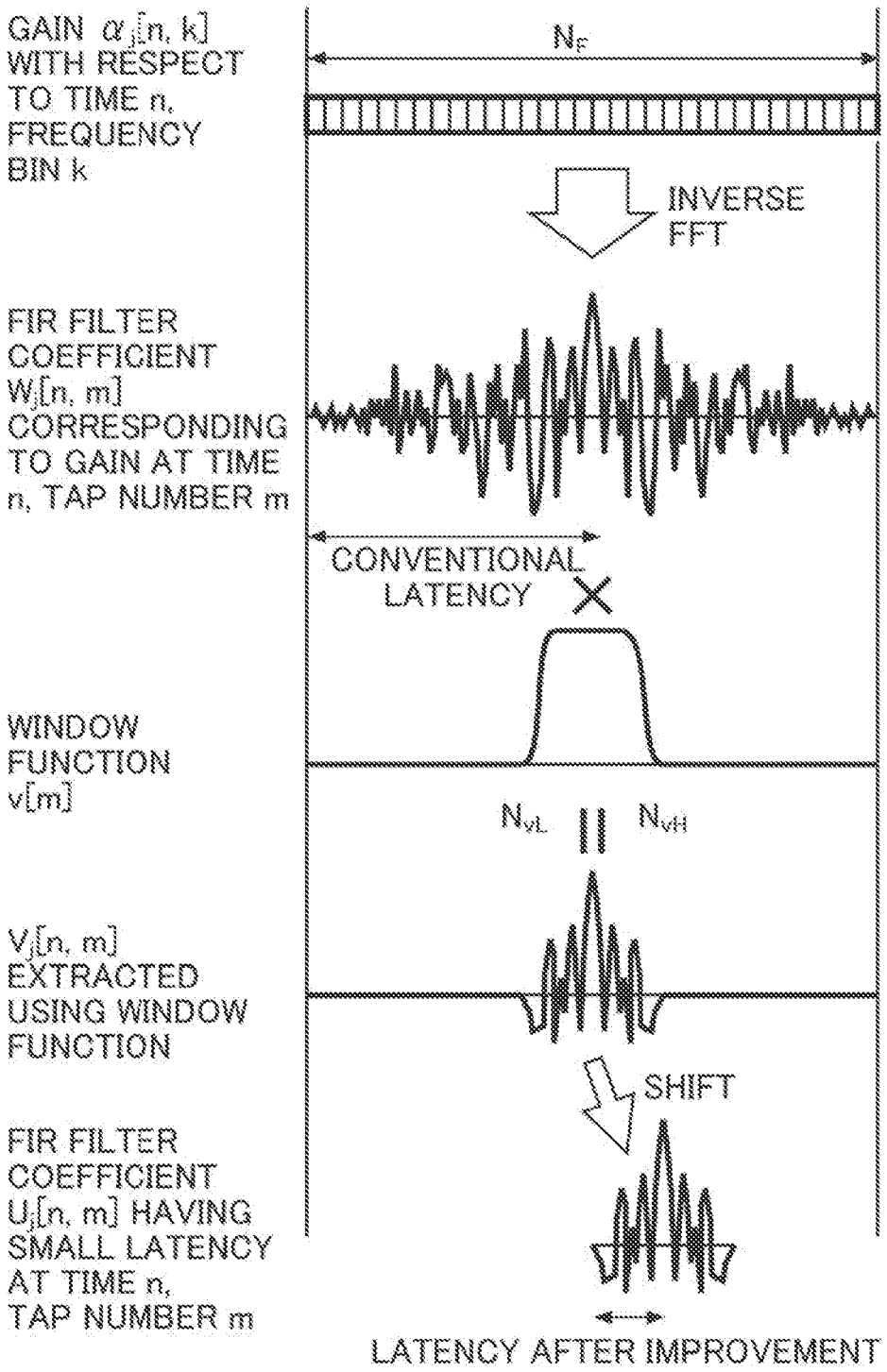
FIG. 7 is a diagram for explaining a principle of the latency reduction by truncating a FIR filter coefficient.

FIG. 7 is a diagram illustrating the latency reduction by truncating the FIR filter coefficient in more detail. An inverse FFT is performed on the gain $\alpha_j[i, k]$ with respect to a frequency bin k at a time n, to create the FIR filter coefficient $W_j[n, m]$ of a tap number m at the time n, corresponding to this gain.

The FIR filter coefficient $W_j[n, m]$ is truncated using a window function v[ ] as indicated by a formula (7), to generate $V_j[n, m]$.

[Formula 7]

$$V_j[n,m]=v[m]W_j[n,m] \tag{7}$$

A window function v[m] is selected so as to assume 0 when $m<=-N_{vL}$ or $m>=N_{vH}$. Further, as illustrated in a lowermost row in FIG. 7, in the FIR filter coefficient $V_j[n, m]$ that is extracted by the window function, a portion where the value 0 occurs successively is shifted by the time shift unit 24, to perform the truncation. A new FIR filter coefficient $U_j[n, m]$ may be represented by a formula (8).

[Formula 8]

$$U_j[n,m]=W_j[n,m-N_{vL}] \tag{8}$$

The output may be obtained using a formula (9), instead of using the formula (6).

[Formula 9]

$$y_j[n] = \sum_{m=0}^{N_{vL}+N_{vH}} U_j[n, m]x_j[n-m] \tag{9}$$

As may be seen from the formula (9), $U_j[n, m]$ has a valid (that is, a non-zero) value in the range of $0<=n<=N_{vL}+N_{vL}$, and thus, no future data is required with respect to the input signal $x_j[n]$. In addition, because the latency is a time corresponding to the coefficient shift performed by the formula (8), the latency becomes $N_{vL}/F_S$. Accordingly, the technique and the configuration of the third embodiment can reduce the latency, as illustrated in FIG. 7.

Figure 8A:
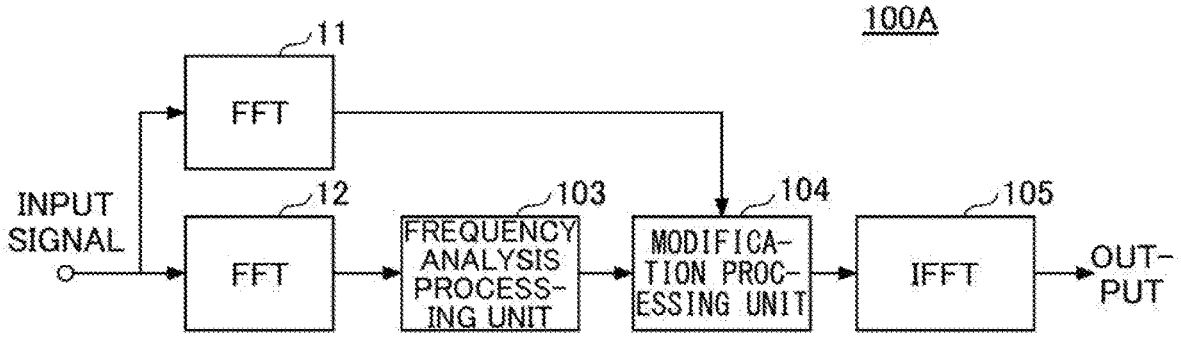
FIG. 8A is a schematic diagram of an information processing device according to one embodiment.
Figure 8B:
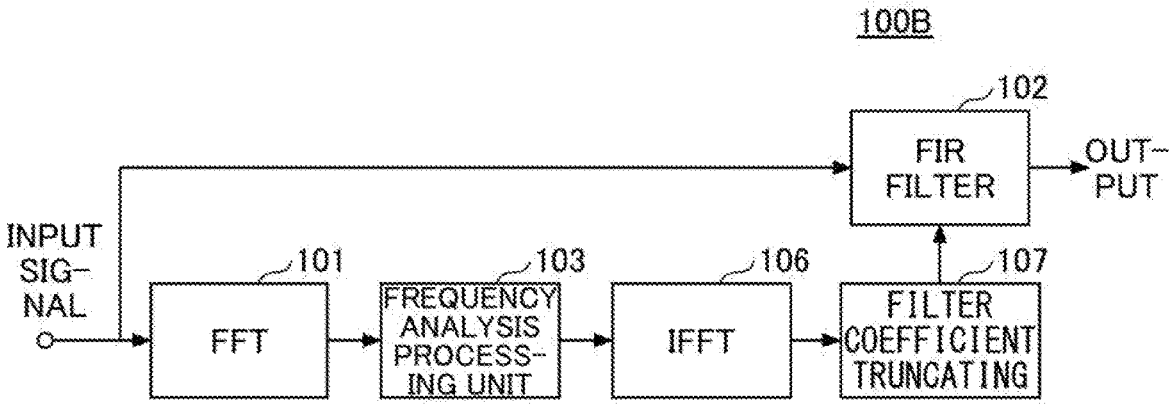
FIG. 8B is a schematic diagram of the information processing device according to one embodiment.

FIG. 8A and FIG. 8B are schematic diagrams of an information processing device applied with the latency reduction method according to one embodiment. An information processing device 100A of FIG. 8A is suited for the techniques according to the first embodiment and the second embodiment. The information processing device 100A includes a modifying FFT 11, an analyzing FFT 12, a frequency analysis processing unit 103, a modification processing unit 104, and an inverse fast Fourier transform (IFFT) unit 105. The input signal is input to the modifying FFT 11 and the analyzing FFT 12. The FFT 11 and the FFT 12 perform a short-time FFT with respect to the input signal using window functions having mutually different widths, to acquire the signal on the time-frequency plane. The number of FFT points of the FFT 11 and the number of FFT points of the FFT 12 may be the same or different. The width of the window function of the FFT 11 is narrower than the width of the window function of the FFT 12. The modifying process by the modification processing unit 104 uses the result of the frequency analysis at a certain time, to modify a signal in the future than the certain time.

The frequency analysis block performs the high-resolution analysis, while the signal modification block reduces the latency to the low latency. Hence, the latency can be reduced in the signal processing as a whole.

The information processing device 100B of FIG. 8B is suited for the technique of the third embodiment. The information processing device includes an analyzing FFT 101, a FIR filter 102, a frequency analysis processing unit 103, an IFFT 106, and a filter coefficient truncating unit 107.

The input signal is input to the FFT 101 and the FIR filter 102. The signal on the time-frequency plane, obtained by the FFT 101, is analyzed by the frequency analysis processing unit 103. The analysis result is returned to the signal in the time domain by the IFFT 106, and is thereafter subjected to the latency reduction process by the filter coefficient truncating unit 107. The signal input to the FIR filter 102 is subjected to the modifying process, using the reduced filter coefficient, and output.

According to this configuration, a high-resolution frequency analysis can be performed, while enabling an input signal modifying process to be performed with a low latency. The modification of the input signal in the time domain is not limited to that of the FIR filter, and other digital filters may be used.

The information processing device 100A of FIG. 8A and the information processing device of FIG. 8B may be implemented in a processor and a memory, for example. Alternatively, the information processing device may be implemented in logic devices, such as a Field Programmable Gate Array (FPGA), a Programmable Logic Device (PLD), or the like.

As described above, the present invention can reduce the latency in a real-time signal processing system that modifies the signal based on the frequency analysis result of the signal. When the present invention is applied to the smart mixer, a high frequency resolution is required for the signal analysis, while the signal modification (priority sound enhancement and non-priority sound reduction) is desirably gradual, that is, has a small latency, which are well adaptable by the latency reduction method of the present invention.

The latency reduction method of the present invention is applicable to information processing devices other than the smart mixer, such as a signal separation system that does not require sound separation of a pulse sound source, or the like, for example.

This application claims priority to Japanese Patent Application No. 2018-080670, filed Apr. 19, 2018, the entire contents of which are hereby incorporated by reference.

DESCRIPTION OF THE REFERENCE NUMERALS

1, 1A-1C Mixing device
11, 11*a*, lib Modifying FFT
12, 12*a*, and 12*b* Analyzing FFT
19 Gain conductor
31, 31*a*, 31*b*, 106 FIR filter (digital filter)
100 Information processing device
103 Frequency analysis processing unit
104 Modification processing unit
10, 106 IFFT
107 Filter coefficient truncating unit (reducing unit)

The invention claimed is:

1. An information processing device, comprising:
a memory; and
a processor connected to the memory,
wherein the processor performs
first time-frequency conversion with respect to an input signal, using a window function having a first width;
second time-frequency conversion with respect to the input signal, using a second window function having a second width smaller than the first width; and
modification processing to modify a second time-frequency conversion result, using a first time-frequency conversion result, and
wherein a number of frequency bins of the second time-frequency conversion is smaller than a number of frequency bins of the first time-frequency conversion.

2. The information processing device as claimed in claim 1, wherein the second window function is an asymmetric window function.

3. The information processing device as claimed in claim 1, wherein the first time-frequency conversion result at a certain time modifies the second time-frequency conversion result obtained at a time after the certain time.

4. A mixing device using the information processing device according to claim 1.

5. A latency reduction method to be implemented in an information processing device which performs a process comprising:
a first time-frequency conversion with respect to an input signal, using a first window function having a first width;
a second time-frequency conversion with respect to the input signal, using a second window function having a second width smaller than the first width; and
a modification with respect to the input signal that has been converted by the second time-frequency conversion, using a frequency analysis result based on the first time-frequency conversion,
wherein a number of frequency bins of the second time-frequency conversion is smaller than a number of frequency bins of the first time-frequency conversion.

6. An information processing device, comprising:
a memory; and
a processor connected to the memory,
wherein the processor performs
first time-frequency conversion with respect to an input signal, using a window function having a first width, with one sample shift, and outputting a first time-frequency conversion result at a sampling frequency same as an input signal sampling frequency, second time-frequency conversion with respect to the input signal, using a second window function having a second width smaller than the first width, with one sample shift, and outputting a second time-frequency conversion result at the sampling frequency same as the input signal sampling frequency, and modification processing to modify the second time-frequency conversion result, using the first time-frequency conversion result.

7. The information processing device as claimed in claim 6, wherein a number of frequency bins of the first time-frequency conversion, and a number of frequency bins of the second time-frequency conversion, are the same.

8. The information processing device as claimed in claim 7, wherein the second window function is an asymmetric window function.

9. The information processing device as claimed in claim 7, wherein the frequency analysis result at a certain time modifies the second time-frequency conversion result obtained at a time after the certain time.

10. The information processing device as claimed in claim 6, wherein a number of frequency bins of the second time-frequency conversion is smaller than a number of frequency bins of the first time-frequency conversion.

11. The information processing device as claimed in claim 10, wherein the second window function is an asymmetric window function.

12. The information processing device as claimed in claim 10, wherein the first time-frequency conversion result at a certain time modifies the second time-frequency conversion result obtained at a time after the certain time.

13. The information processing device as claimed in claim 6, wherein the second window function is an asymmetric window function.

14. The information processing device as claimed in claim 13, wherein the first time-frequency conversion result at a certain time modifies the second time-frequency conversion result obtained at a time after the certain time.

* * * * *